United States Patent [19]

Lehman

[11] Patent Number: 4,593,934

[45] Date of Patent: Jun. 10, 1986

[54] NEWSPAPER HOLDER

[76] Inventor: Andrew S. Lehman, 960 Bellmore Ave., North Bellmore, N.Y. 11710

[21] Appl. No.: 668,330

[22] Filed: Nov. 5, 1984

[51] Int. Cl.[4] ..... B42D 17/00; B42D 3/04

[52] U.S. Cl. ..... 281/45; 281/35

[58] Field of Search ..... 281/45, 35, 34, 18, 281/17, 19 R; 402/8, 14, 20, 3; 412/3, 4, 5

[56] References Cited

U.S. PATENT DOCUMENTS

| | | | |
|---|---|---|---|
| 982,758 | 1/1911 | Anderson | 281/19 R |
| 2,788,041 | 4/1957 | Carver | 281/35 |
| 3,168,424 | 2/1965 | Sendor | 281/35 |
| 3,206,225 | 9/1965 | Oleson | 412/3 |
| 4,374,441 | 2/1983 | Carter et al. | 412/3 |

FOREIGN PATENT DOCUMENTS

| | | | |
|---|---|---|---|
| 437883 | 10/1935 | United Kingdom | 281/35 |

*Primary Examiner*—Paul A. Bell
*Assistant Examiner*—Paul M. Heyrana, Sr.
*Attorney, Agent, or Firm*—Bauer & Amer

[57] ABSTRACT

An article of manufacture which can be folded in a loosely closed condition about a newspaper, to obviate the inadvertent transfer of newsprint therefrom, and released to partake of a slight opening movement which correspondingly releases the individual pages for facilitated reading of the newspaper.

3 Claims, 5 Drawing Figures

NEWSPAPER HOLDER

The present invention relates generally to an inexpensive convenience article of manufacture, such as is appropriate for use as an advertising give-away or premium, and more particularly to a newspaper holder in the category noted which eliminates newsprint smudging.

It is a common experience that when reading a newspaper the newsprint will inadvertently be transferred to clothing and the like. Underlying the present invention is the recognition that a normal, comfortable reading position can be used to advantage to support the newspaper during the reading thereof, and that a holder used at this time can provide newsprint-free contact with the newspaper. Further, and another of the inventive objectives, is to fabricate the within holder for economical mass production, so that it can be given away and when used in public by the recipients, then display an advertising or promotional message.

An article of manufacture for use in holding a folded newspaper along its fold line to obviate the transfer of newsprint to the holder's hand while said paper is being read which demonstrates objects and advantages of the present invention includes a body consisting of four cardboard strips in an operative arrangement in which the strips are in adjacent relation to each other with a central clearance space and two adjacent auxiliary clearance spaces being bounded in the operative arrangement by the adjacent edges of the four strips. Completing the body are two heat fusable plastic plies disposed on opposite sides of the four cardboard strips and heat sealed to each other about their respective peripheries to confine the four cardboard strips therebetween and having additional interconnecting heat seals along the central and the auxiliary clearance spaces. The holder, constructed as just generally described, is adapted to be placed in a closed condition about said newspaper, being folded along said heat seals, and thus provides a newsprint-free grip therewith, and additionally there is exerted a slight bias in the holder to partake of opening movement, which facilitates release of the individual pages of the newspaper as required for reading.

The above brief description, as well as further objects, features and advantages of the present invention, will be more fully appreciated from the following detailed description of a presently preferred, but nonetheless illustrative embodiment in accordance with the present invention, when taken in conjunction with the accompanying drawings, wherein.

Figure 4:
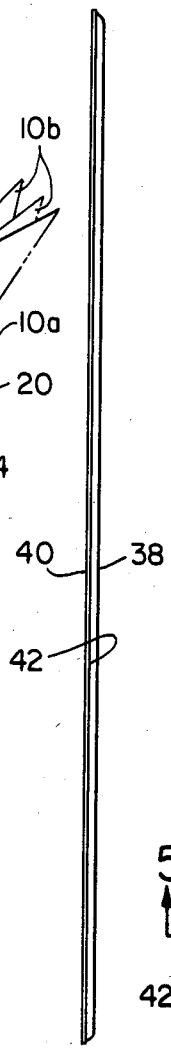

The remaining figures illustrate structural features of the holder per se. More particularly, FIG. 3 is a front elevational view of the newspaper holder;

FIG. 4 is a side elevational view thereof; and

Figure 3:
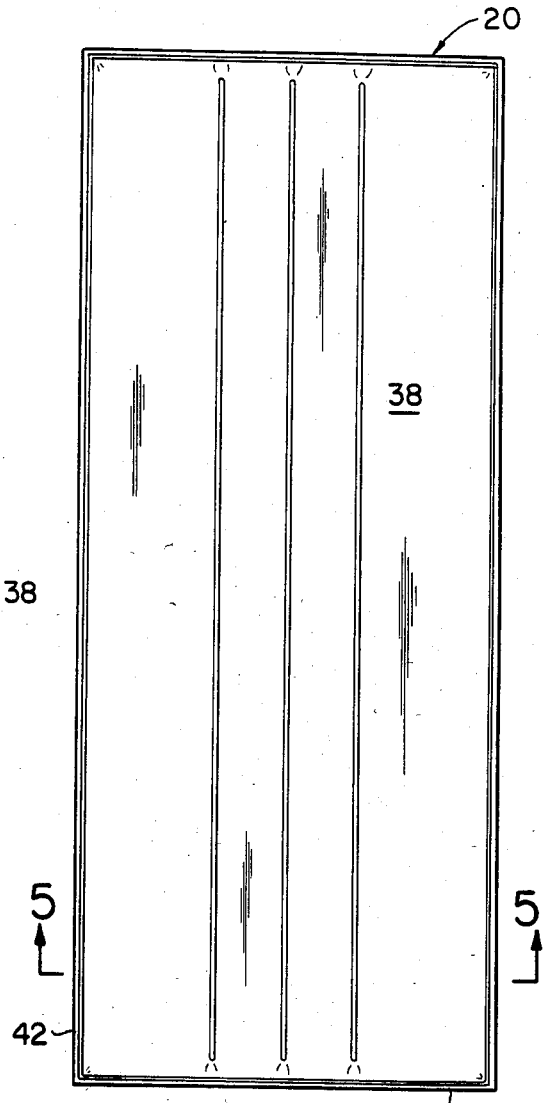
Figure 5:
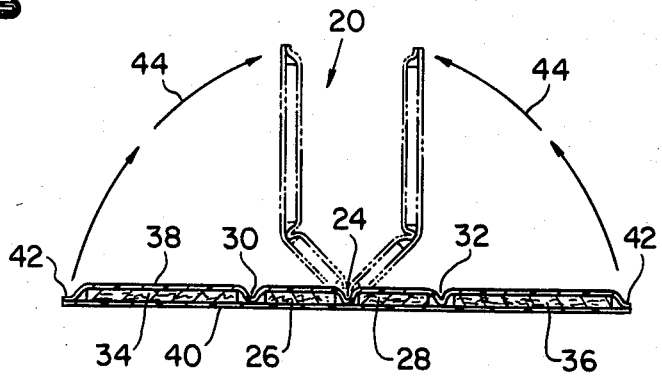

FIG. 5 is a sectional view, taken along line 5—5 of FIG. 3, showing further structural details.

Figure 2:
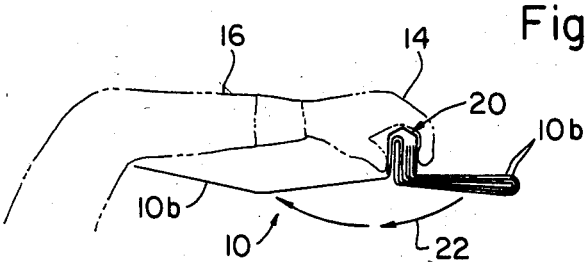
FIG. 2 is a plan view showing how the user's hand supports the newspaper and how there is facilitated release of the newspaper pages in accordance with the present invention.

It is a common experience that when reading a newspaper 10 the newsprint 12 will inadvertently transfer to the holder's hand 14, with the consequent annoyance of being further inadvertently transferred and soiling clothing and the like. In accordance with the present invention, a normal, comfortable reading position is used to advantage wherein the reader's arm 16, as best shown in FIG. 2, is used to support the newspaper 10 during the reading thereof, while a holder 20 constituting the inventive article of manufacture hereof, provides newsprint-free contact with the newspaper. Also, and most important, the construction of the holder 20, as will be explained in detail subsequently herein, readily permits not only the newspaper to be gripped in a compact folded position, but also has a built-in bias to release the individual pages thereby greatly facilitating the use of the holder 20 during reading of the newspaper.

Figure 1:
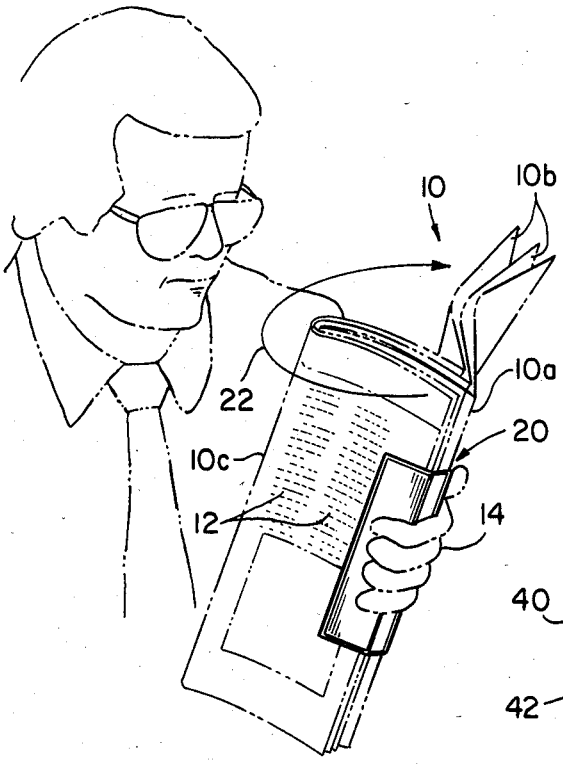
FIG. 1 is a perspective view showing the use contemplated for the newspaper holder herein.

More particularly, and as is best illustrated in FIG. 1, the newspaper 10 is of the type that is typically folded in half along a central fold line 10*a*. To provide a convenient compact size, the individual pages, herein individually and collectively designated 10*b*, are folded again in half, as along the fold line 10*c*, and said newspaper in the folded condition just described is then inserted in the holder 20. The pages are then released for movement as indicated by the arrow 22 which exposes all of the surfaces for reading. The release of the individual pages consists of the reader merely easing the pressure in his hand 14, which results in the holder 20 partaking of slight opening movement, and this of course releases the remote edge of each folded back page so that it can be moved through the path 22 by the reader's right hand. This, of course, exposes the reader's right hand to nominal newsprint smudging, but this is significantly minor compared to the smudging that would ordinarily occur on the reader's hand 14 which actually supports the newspaper, and which is obviated by the use of the within holder 20.

A preferred form of the holder 20 which achieves the objectives previously noted, and which contributes to economical mass production, is illustrated in FIGS. 3–5. The body of the holder 20 is comprised of four cardboard strips, each of the same length and disposed in an operative arrangement in which they are in adjacent side-by-side position and in which, as best illustrated in the cross-sectional view of FIG. 5, there is a central clearance space 24 between the two narrower middle strips 26 and 28, and two auxiliary adjacent clearance spaces 30 and 32 between these narrow strips and the wider strips 34 and 36. Placed on opposite sides of the four cardboard strips are two heat sealable plies of plastic, such as vinyl, and the assembly is then peripherally heat sealed, as at 38, to confine the cardboard strips between the two piles. The assembly is then completed by additional heat seals in the clearances 24, 30 and 32, said heat seals being similarly numerically designated.

As a result of the heat seals 24, 30 and 32, the holder 20 can of course be folded in closing movement 44 about the newspaper, thus assuming the U-shape illustrated in FIG. 5. Additionally, and most important, because of the bulk of the cardboard strips confined within the plies 38 and 40, there is an urgency or bias which promotes an opening movement in the holder 20, or, in other words, a movement in a direction opposite to the closing movement 44. This is used to advantage in accordance with the present invention in that, as already explained, the reader merely has to ease up on the grip of his hand 14 which will result in slight opening movement of the holder 20, and this in practice results in a release of the folded pages within the holder sufficient to allow for the movement 22 in said individual pages, thereby enabling the reader to read the newspaper 10 while being spared direct contact with the newspaper. This avoids inadvertent transfer of the newsprint which otherwise would result from such contact.

In a preferred embodiment, the holder 20 is $3\frac{3}{4}$ inches wide and 9 inches long, and the strips 26, 28 9/16 of an inch, and the strip 34, 36 $1\frac{1}{8}$ of an inch. The surfaces are also printed with advertising or a commercial message, so that the holder 20 is an ideal premium item.

A latitude of modification, change and substitution is intended in the foregoing disclosure, and, in some instances, some features of the invention will be employed without a corresponding use of other features. Accordingly, it is appropriate that the appended claims be construed broadly and in a manner consistent with the spirit and scope of the invention herein.

What is claimed is:

1. An article of manufacture for use in holding a folded newspaper along its fold line to obviate the transfer of newsprint to the holder's hand while said paper is being read, said holder comprising a body consisting of four cardboard strips in an operative arrangement in which said strips are in close adjacent relation to each other with a relatively small central clearance space and two similarly relatively small adjacent auxiliary clearance spaces being bounded in said operative arrangement by the adjacent edges of said four strips, said strips having a width variation in which the two inner strips are each approximately one half the width of the two outer strips and do not exceed three quarters of an inch, and two heat fusable plastic plies disposed on opposite sides of said four cardboard strips and heat sealed to each other about their respective peripheries to confine said four cardboard strips therebetween and additionally sealed along three lines to each along said relatively small central and said auxiliarly clearance spaces, such that when said holder is in a closed condition about said newspaper along said three heat seals said holder provides a newsprint-free grip therewith by assuming a U-shaped configuration about said newspaper which is the sum of closing movement of said inner strips about said central seal and of closing movement of each inner strip with its adjacent outer strip about each said auxiliary seal, said four cardboard strips being of a height relative to said width of said three relatively small seals to cause engagement of the adjacent edges of said strips with each other during the assumption of said U-shaped configuration, whereby as a result of said engagement there is exerted a slight bias in said U-shaped configuration to partake of opening movement which facilitates release of the individual pages of the newspaper as required for reading.

2. A newspaper holder as claimed in claim 1 wherein the size thereof is approximately $3\frac{3}{4}$ inches by 9 inches, so as to occupy fully an interposed position between the reader's hand and the newspaper being supported therein.

3. A newspaper holder as claimed in claim 2 including advertising imprinted on the surfaces thereof, to correspondingly enhance its value as a premium item.

* * * * *